US007455079B2

(12) United States Patent
Sitarz et al.

(10) Patent No.: US 7,455,079 B2
(45) Date of Patent: Nov. 25, 2008

(54) VENETIAN BLIND TAPE

(75) Inventors: Michael J. Sitarz, Dartmouth, MA (US); Lewis M. Coco, Horshoe Bay, TX (US); Thomas P. Kefor, Norton, MA (US)

(73) Assignee: Julius Koch USA, Inc., New Bedford, MA (US)

( * ) Notice: Subject to any disclaimer, the term of this patent is extended or adjusted under 35 U.S.C. 154(b) by 0 days.

(21) Appl. No.: 11/334,057

(22) Filed: Jan. 18, 2006

(65) Prior Publication Data

US 2006/0157136 A1 Jul. 20, 2006

Related U.S. Application Data

(60) Provisional application No. 60/645,378, filed on Jan. 20, 2005.

(51) Int. Cl.

| | |
|---|---|
| ***D03D 1/08*** | (2006.01) |
| ***E06B 9/382*** | (2006.01) |
| *D03D 3/02* | (2006.01) |
| *D03D 1/06* | (2006.01) |

(52) U.S. Cl. ..... 139/384 A; 139/387 R

(58) Field of Classification Search ..... 139/384 A, 139/387 R

See application file for complete search history.

(56) References Cited

U.S. PATENT DOCUMENTS

| | | | | |
|---|---|---|---|---|
| 2,031,981 | A | 2/1936 | Runge | |
| 2,156,150 | A * | 4/1939 | French | 139/384 A |
| 2,156,151 | A * | 4/1939 | French | 139/384 A |
| 2,247,999 | A * | 7/1941 | Holden | 139/22 |
| 4,150,698 | A * | 4/1979 | Griffith | 139/55.1 |
| 4,191,361 | A | 3/1980 | Jensen | |
| 6,033,512 | A * | 3/2000 | Coco et al. | 156/230 |
| 6,260,585 | B1 | 7/2001 | Speich | |
| 6,328,078 | B1 * | 12/2001 | Wildeman et al. | 139/383 R |
| 2003/0136527 | A1 * | 7/2003 | Weiss | 160/271 |
| 2003/0139840 | A1 * | 7/2003 | Magee et al. | 700/133 |
| 2006/0021717 | A1 * | 2/2006 | Graichen | 160/168.1 V |
| 2006/0157136 | A1 * | 7/2006 | Sitarz et al. | 139/11 |

OTHER PUBLICATIONS

Google.com, search term 'Define: Jacquard Weaving'.*

* cited by examiner

*Primary Examiner*—Bobby H Muromoto, Jr.
(74) *Attorney, Agent, or Firm*—Salter & Michaelson

(57) ABSTRACT

A Venetian blind tape that includes face and rear bands, each of a textile material woven from a loom. A plurality of cross-band members are inter-woven between the face and rear bands and are spacedly disposed along the bands to form supports for blind slats. At least the face band has a discernable decorative pattern woven into it by means of a Jacquard weaving mechanism that is characterized by independent single thread control.

8 Claims, 8 Drawing Sheets

VENETIAN BLIND TAPE

RELATED APPLICATION

The present application claims priority to U.S. Provisional Application Ser. No. 60/645,378 filed on Jan. 20, 2005.

TECHNICAL FIELD

The present invention relates in general to a woven Venetian blind tape and an associated method or technique of manufacture. More particularly, the present invention relates to a woven Venetian blind tape that is provided with a more detailed decorative woven-in design on at least the face band of the tape.

BACKGROUND

Currently, in order to obtain a more decorative cloth tape some users are bonding a separate decorative trim fabric to the standard cloth Venetian blind tape by stitching or adhesives. One of the drawbacks to this technique is that it makes for a rather bulky and cumbersome blind tape. The added bulk of the adhered trim can degrade the performance of the Venetian blind. This, in particular, can affect the closure, spacing and folding ability as the blind is raised and/or lowered. Due to the additional fabric and the labor to attach it to the tape there is also a much higher cost involved with this solution in order to get a decorative effect on a Venetian blind tape.

Another example of a technique for applying a decorative color or pattern to a stock Venetian blind tape material is found in U.S. Pat. No. 6,033,512 commonly owned with the present assignee. Although this is an improvement over past techniques, it still does not provide a high quality woven-in design.

Standard tapes have been manufactured using either a conventional loom with 3 or 4 shuttles or a narrow fabric needle loom with a double weft insertion feature that allows the two fabric tape to be made. All of these types of looms use harnesses with heddles to raise and lower the warp threads in groups. With the standard weaving techniques it is possible to obtain only relatively simple pattern weaves, such as described in U.S. Pat. No. 2,031,981. The relatively small number of harnesses available on these looms is generally the limiting factor in the degree of decorative design that can be woven on the fabric face.

Prior to the present invention, it was not believed possible to provide a double face Venetian blind tape having a highly decorative woven-in design. There was not believed to be sufficient adjustment in the lift of the "hooks" i.e., the thread lifting mechanism, to enable one to make a double face fabric. There was also doubt about having enough threads available after the base tape was made to impart anything more than only a rudimentary decorative pattern. In other words most of the yarn used in making the basic tape would be used up with little remaining for any sort of a reasonably decorative woven design.

Accordingly, it is an object of the present invention is to provide an improved woven Venetian blind tape that has a highly decorative woven-in design on the face band of the tape.

Another object of the present invention is to provide an improved weaving apparatus capable of providing such an improved decorative design.

A further object of the present invention is to provide an improved weaving apparatus capable of constructing a Venetian blind tape that maintains proper functioning with regard to closure, uniform slat spacing and the proper folding into pleats when the slats are raised.

SUMMARY OF THE INVENTION

In accordance with the present invention, in a preferred embodiment thereof, a Jacquard weaving technique is employed enabling the formation of more intricate woven patterns while at the same time allowing for a more controlled, precise lifting of the threads to provide the weaving of the double fabric construction needed to produce Venetian blind tapes with a decorative woven-in design on at least the face band of the tape.

In accordance with one aspect of the present invention there is provided a Venetian blind tape that includes face and rear bands, each of a textile material woven from a loom and a plurality of cross-band members that are inter-woven between the face and rear bands and that are spacedly disposed along the bands to form supports for blind slats. In accordance with the improvement of the present invention at least the face band has a discernable decorative pattern woven into it by means of a Jacquard weaving mechanism that is characterized by independent single thread control thereby.

In accordance with another aspect of the present invention there is provided a weaving apparatus for forming a Venetian blind tape that is constructed of face and rear bands that are periodically intercoupled by means of cross-band members at a forming station. The apparatus comprises: a first mechanism for conveying a first set of adjacent planar disposed warp threads to the forming station for the purpose of constructing part of the face band; a second mechanism for conveying a second set of adjacent planar disposed warp threads to the forming station for the purpose of constructing part of the rear band; a double weft insertion device at the forming station for weaving respective first and second weft threads with the first and second sets and control means for controlling the warp thread sets using independent single thread control.

In accordance with still other aspects of the present invention; the number of warp threads used for forming the face band is preferably greater than the number of warp threads used for forming the rear band; the size or diameter of the warp threads used for the face band is preferably smaller than the size or diameter of the warp threads used for the rear band; the ratio in number is on the order of two-to-one and the ratio in size is on the order of one-to-two.

DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings, in which.

DETAILED DESCRIPTION

Figure 1:
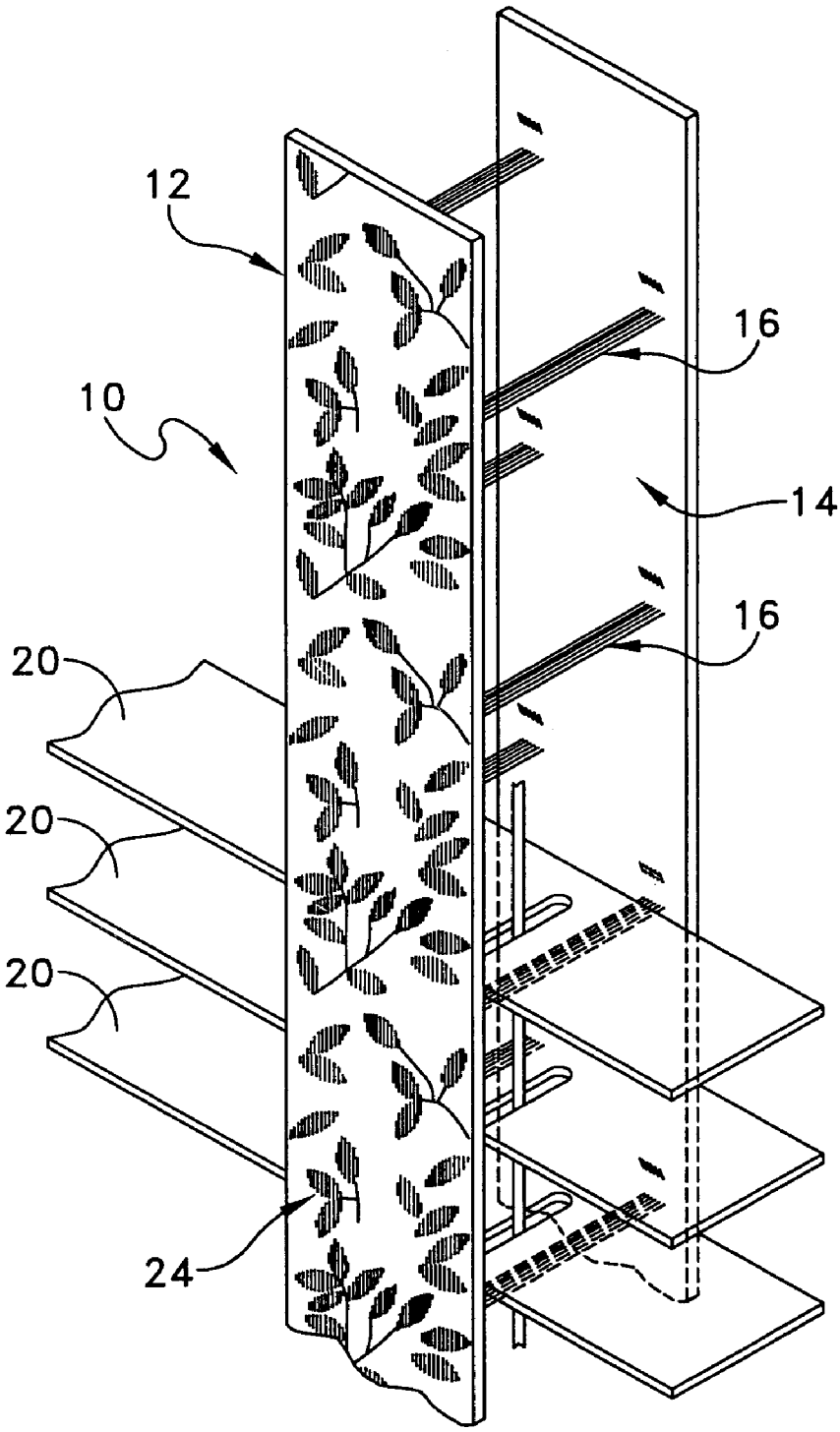
FIG. 1 is a perspective view of a section of Venetian blind tape illustrating a decorative pattern on one face thereof produced in accordance with the principles of the present invention.

Reference is now made to FIGS. 1-8. FIG. 1 depicts the Venetian blind tape 10. This tape 10 is illustrated as comprised of a face band 12 and a rear band 14, each of a textile material and a plurality of cross-band members 16 that are inter-woven between the face and rear bands and that are spacedly and vertically disposed along the bands to form supports for blind slats 20. In accordance with the improvement of the present invention at least the face band has a discernable decorative pattern, at 24, woven into it by means of a Jacquard weaving mechanism that is characterized by independent single thread control. FIGS. 2-8 show various views of the machine that has been modified in order to produce the woven Venetian blind tape of the present invention having a highly decorative woven-in design pattern. The basic machine, before being modified, may be a Jakob Muller AG machine Model No. NFJK. This machine has been modified to add a double weft insertion so as to enable the formation of a weaved double face Venetian blind tape.

In the drawings of FIGS. 2-8 the basic machine that has been illustrated, as discussed previously, is a Muller NFJK machine, also referred to as a narrow fabric loom. Such a machine is designed to weave Jacquard patterned articles such as ribbon, decorative belting and single face labels. However, these machines have not been used in the past to make Venetian blind tapes. In accordance with the present invention, this machine is modified to add the double weft insertion so as to enable one to form Venetian blind tapes. Moreover, the machine is provided with a computer assisted design program so as to enable one to form many different patterning effects quickly and easily, and under computer control.

The new ladder tape made on a Jacquard needle loom (Muller NFJK) with the double weft insertion allows a much more intricate design to be woven into the face fabric. The Jacquard mechanism allows each individual warp thread to be raised or lowered at each weft insertion which enables a much higher detail in the design. In combining the Jacquard, single thread control, in combination with the double weft insertion, it has been further found that a more intricate pattern can be woven by preferably using a greater number of warp threads in the face band of the tape than are used in the back or rear band fabric. Preferably the decorative face construction uses, on the order of twice the number of warp threads than the number of warp threads used in the back fabric.

Also, in accordance with the present invention it is preferred that the warp threads for the face band be on the order of one half the size or diameter of the rear band threads in order to have the density of both fabrics (face and rear) be substantially the same. In this way one is able to keep the proper spacing and closure performance. This is a far superior approach to that of adhering a, separate trim piece to the tape. The cost advantage of imparting the design directly during the weaving process is also much greater since there is no need to introduce another costly fabric and the associated labor to attach it.

Another advantage of the concepts of the present invention is the ability to disguise the thread binding area where the ladder threads are woven into the face fabric. In a normally constructed blind tape, this binding area shows on the surface due to the higher density of yam. With the Jacquard type control of the present invention, one is able to bind the ladder threads into the face fabric using threads at a lower level that will allow the decorative pattern to use the upper level threads and thus hide the higher density area below the surface.

In this description reference is made to "threads" as forming the tape. It is understood that this term is to be considered in its broadest sense. For example, this includes essentially any synthetic or natural fiber and may also be referred to as fibers, filaments, threads or cords.

Figure 2:
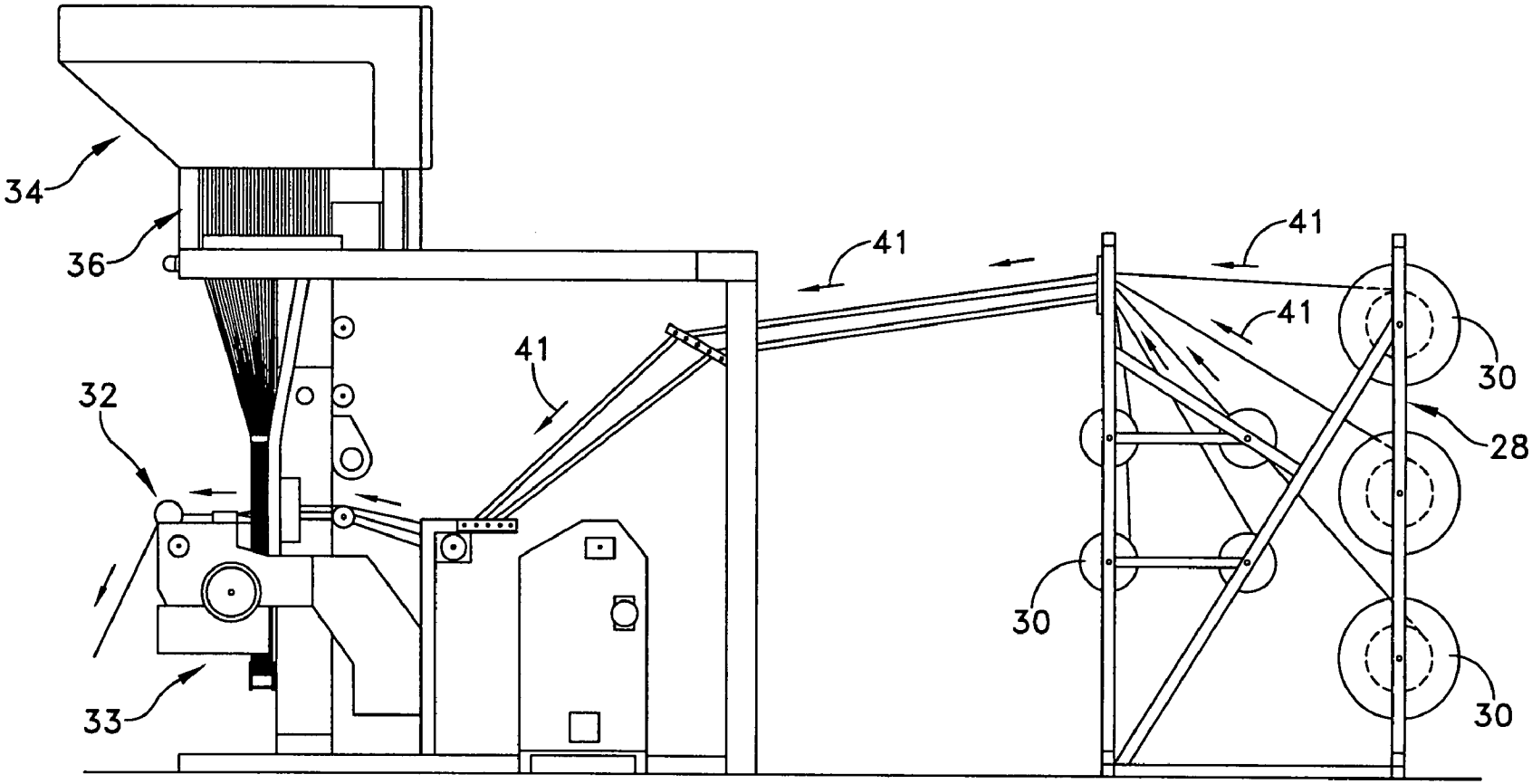
FIG. 2 is a side elevation view of a weaving machine, that is used in performing the technique of the present invention.

FIG. 2 is a side elevation view that schematically illustrates the overall weaving apparatus. A stand 28 is provided for supporting a plurality of spools 30 that carry the warp threads 40. A series of arrows 41 in FIG. 2 illustrate the direction of movement of the threads to a forming station 32. The Jacquard machine 33 is depicted in FIG. 2. As indicated before, the basic machine, before being modified, may be a Jakob Muller AG machine Model No. NFJK. The forming or weaving station 32 is considered to be the general area where the Venetian blind tape is formed.

FIG. 2 also depicts the control means 34 that provides the individual control of the lifting of warp threads. For this purpose there is provided an array of heddles each of which is individually controlled and each of which, in turn, controls a single warp thread. The control means 34 may be considered as conventional and is computer operated for controlling the individual heddles 36. This is provided in a controlled and programmed manner and is a function of the particular pattern that is selected by the operator of the machine.

Figure 3:
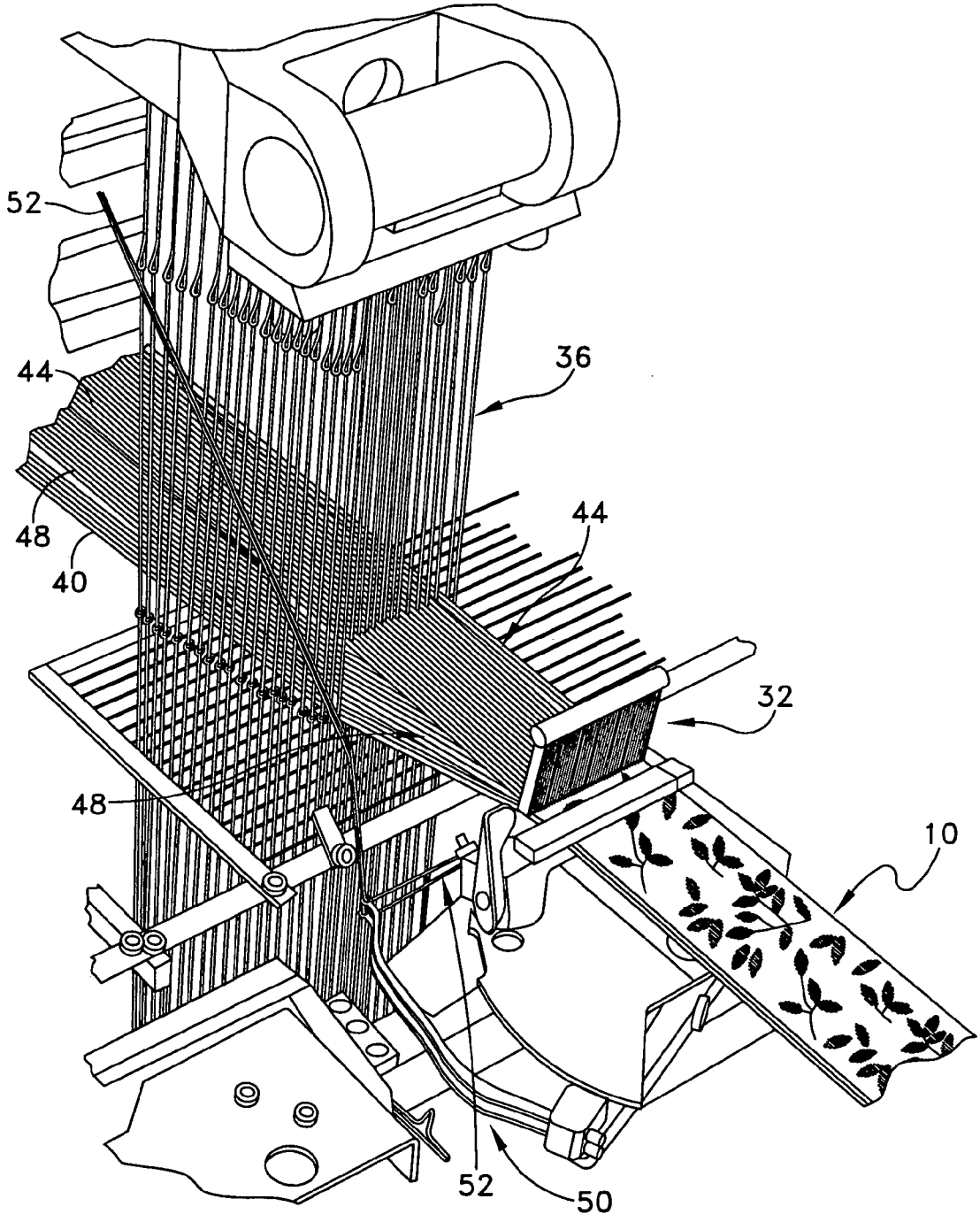
FIG. 3 is a fragmentary perspective view illustrating the tape being constructed at a weaving or forming station of the machine.

FIG. 3 is a perspective view that provides further details of the weaving apparatus and process. The array of heddles 36 control the warp threads 40. Each of the heddles 36 is provided with a small eyelet for receiving one of the warp threads 40. The heddles 36 are adapted to transition longitudinally under control of the computer control system to lift warp threads in a sequence corresponding to the programmed pattern. There is thus provided a first mechanism for conveying a first set 44 of planar disposed warp threads coupling them to the forming station 32. FIG. 3 also shows a second mechanism for conveying a second set 48 of adjacent planar disposed warp threads to the forming station 32. The set 44 of warp threads is used for constructing the face band 12. The set 48 of warp threads are used for constructing the rear band 14. FIG. 3 also illustrates the double weft insertion mechanism 50 for controlling the respective weft threads 52.

Figure 4:
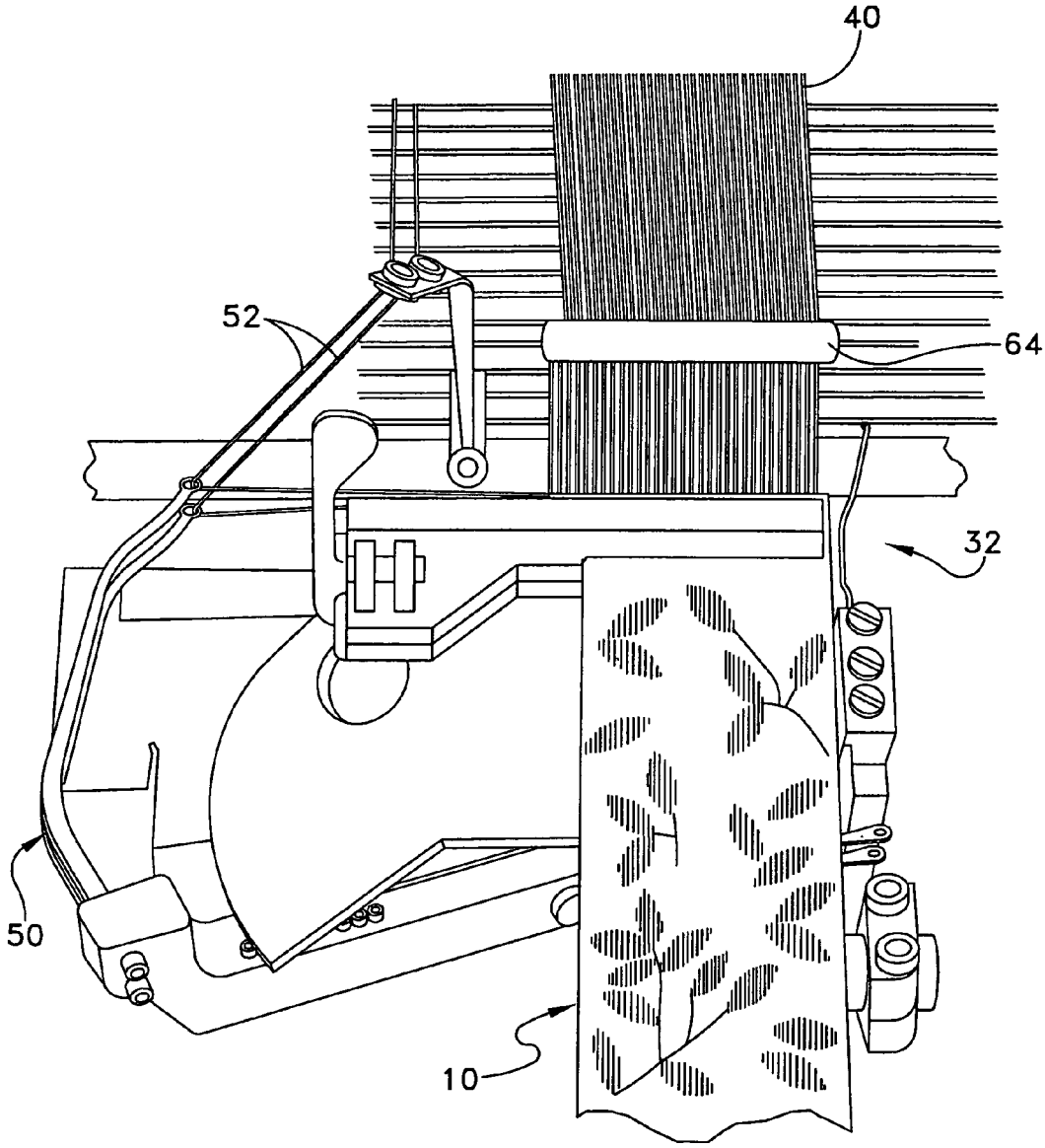
FIG. 4 is a partial perspective view at the forming station for an initial position of the weft insertion mechanism.
Figure 5:
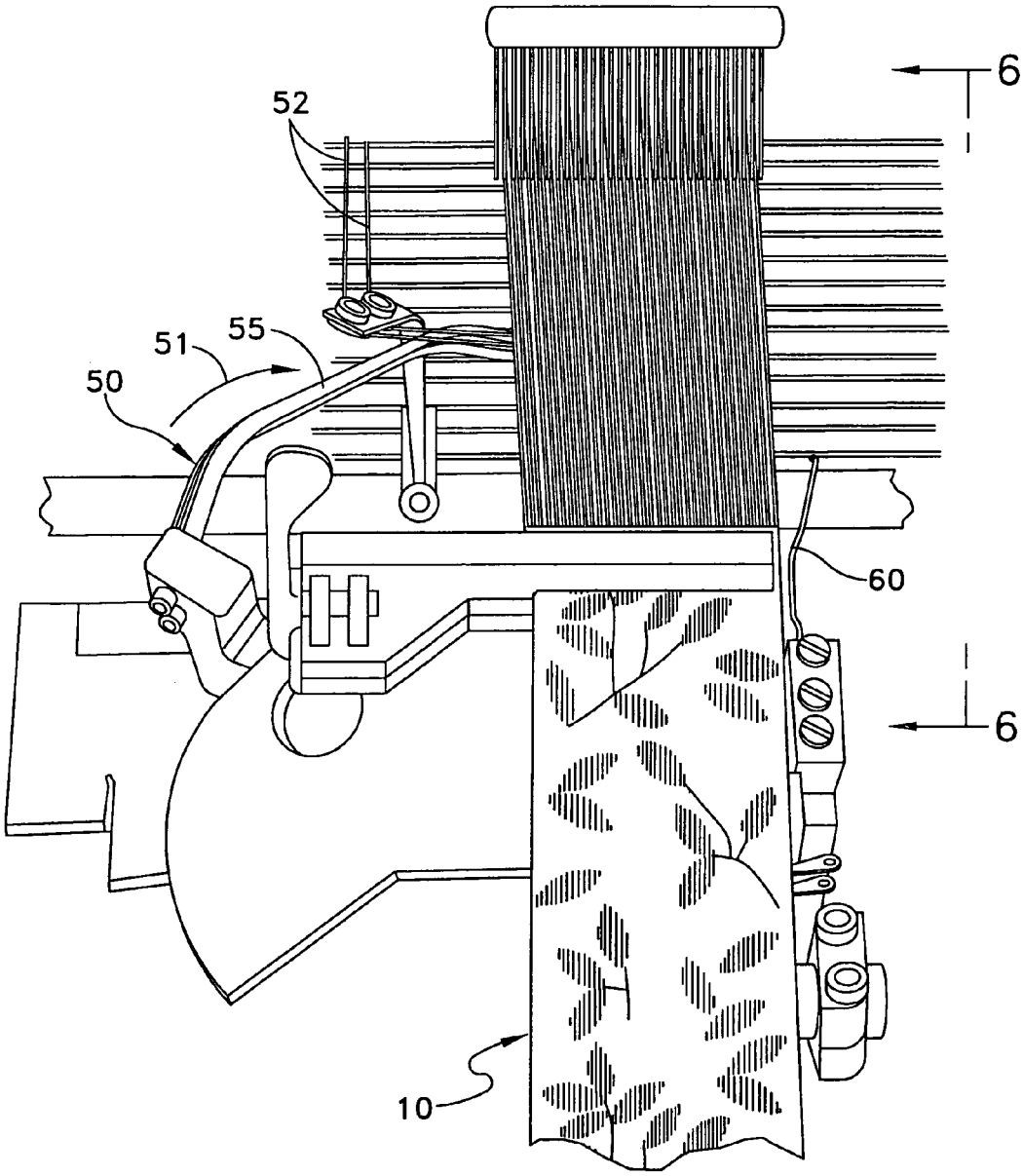
FIG. 5 is a partial perspective view at the forming station showing the weft insertion mechanism transitioning the warp threads.
Figure 6:
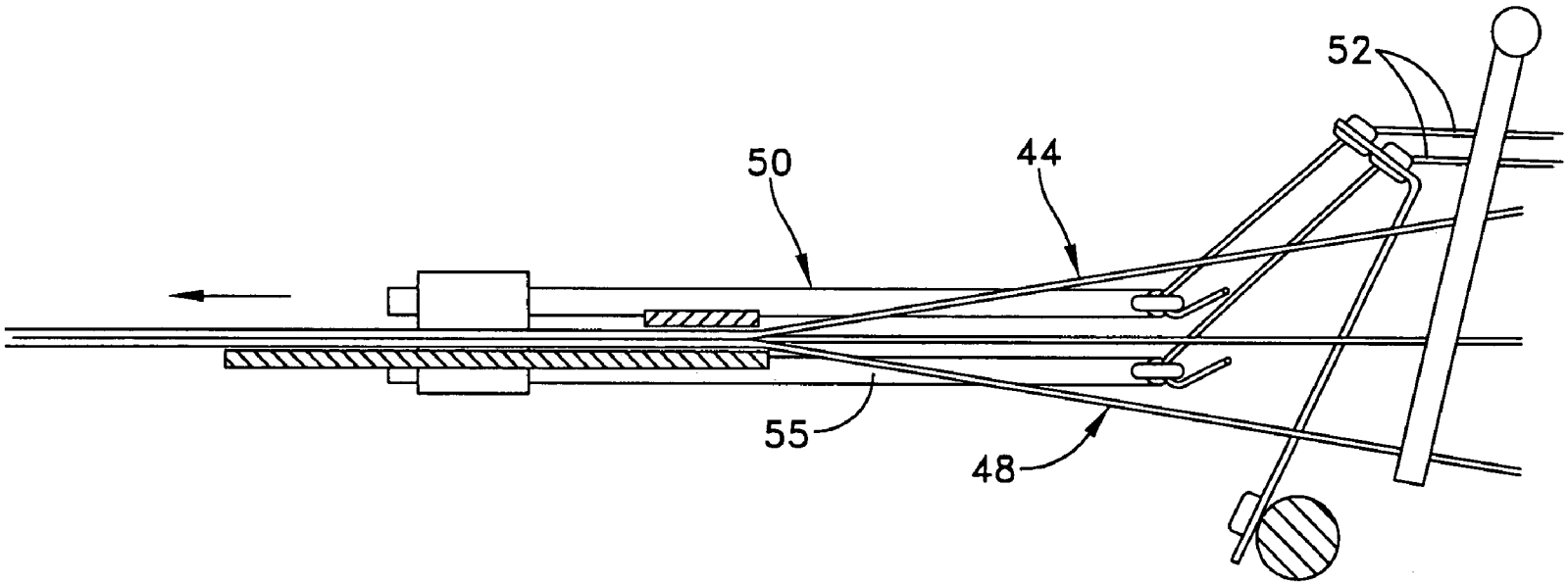
FIG. 6 is a cross-sectional view taken along line 6-6 of FIG. 5.

As illustrated in FIGS. 4 and 5, the double weft insertion mechanism 50 includes a pair of control arms 55. FIG. 4 shows this mechanism in what can be considered an initial position before the weft threads transition across the warp threads. FIG. 5 illustrates the insertion mechanism 50 rotating in the direction of arrow 51 across the warp threads. Refer also to the cross-sectional view of FIG. 6 for an illustration of the positioning of the arms 55 relative to the respective sets 44 and 48 of warp threads 40.

Figure 7:
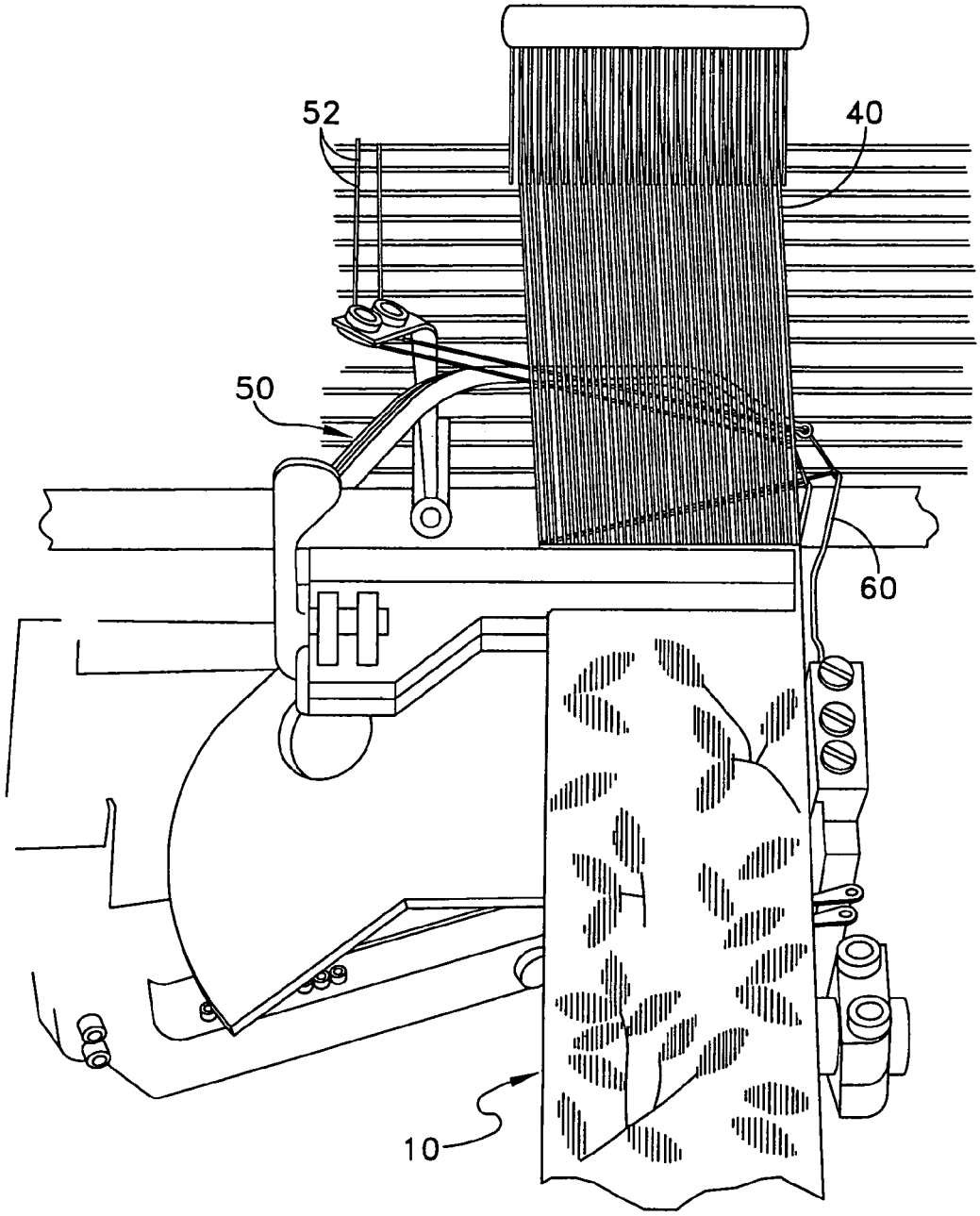
FIG. 7 is a partial perspective view at the forming station for a position of the weft insertion mechanism fully transitioned.
Figure 8:
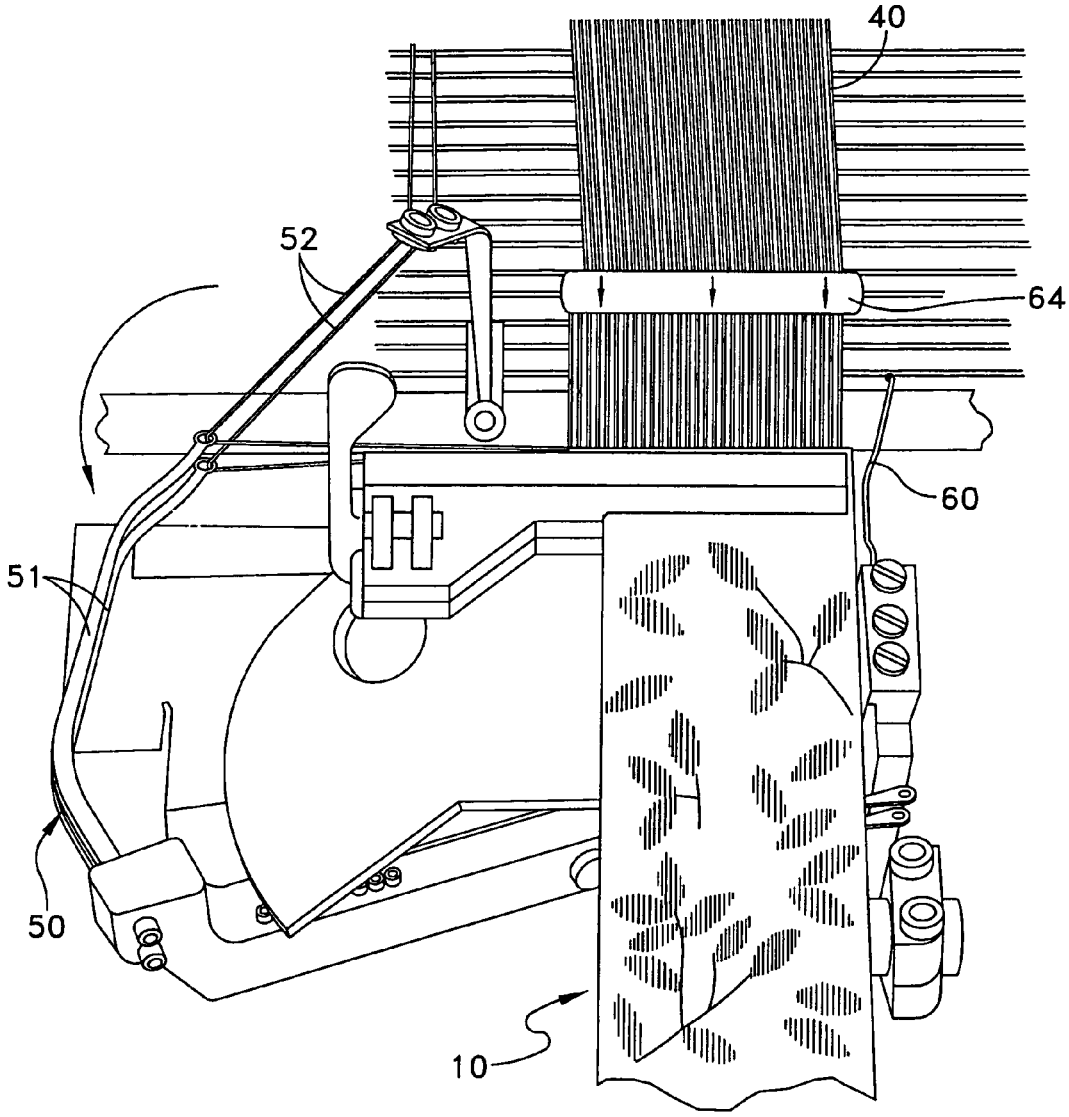
FIG. 8 is a partial perspective view at the forming station where the weft insertion mechanism has returned to its initial position.

FIG. 7 illustrates the double weft insertion mechanism 50 having transitioned fully to the right so that the weft threads 52 can be engaged by the conventional hook 60. FIG. 8 illustrates the insertion mechanism 50 having been returned fully to its initial position. The comb 64 is moved in the direction of the associated arrows to close and tighten the weaving.

Thus, in accordance with the present invention there is provided a technique for making a woven Venetian blind tape that has a highly decorative woven-in design pattern on the face band of the tape. This is made possible by a unique combination of elements. A Jacquard style warp thread control is provided that is computer controlled to enable the formation of a number of different types of design patterns. This is combined with a double weft insertion so as to provide a Venetian blind tape having front and back bands. The Jacquard mechanism allows each individual warp thread to be raised or lowered at each weft insertion which enables a much higher detail in the design pattern.

Furthermore, by increasing the number of warp threads in the face band, in comparison to that in the back fabric, and likewise proportionally decreasing the size of the warp threads on the face band, there is provided a Venetian blind tape construction that has proper function with regard to closure, uniformed slat spacing, and the proper folding into pleats when the slats are raised. This provides like densities for the face and rear bands. This also provides for the proper front and back fabric elongation characteristics so that they are very close in specification to each other to enable proper blind closure. As indicated previously, it is preferred that the front decorative face have twice the number of threads or ends as the back face but that these yarns will be about half the size. This will provide the same fabric density and allow the proper elongation specifications to be met.

In one example the weft threads may be a 150/2 textured polyester yarn. The yarns may be the same size and texture for both the face and rear bands. As indicted before the warp threads for in the face bans are twice the number in the rear band. For example, the number of threads in the decorative face band may be 180 while the number of threads in the rear band may be 90. The face fabric warp threads can be approximately half the size or diameter of the rear fabric warp threads. The face threads may be 300 denier and the rear threads may be 660 denier which is substantially equivalent to 16/2 spun yarn.

Having now described a limited number of embodiments of the present invention it should be apparent to those skilled in the art that numerous other embodiments and modifications thereof are contemplated as falling within the scope of the present invention, as defined by the appended claims. For example, it has been mentioned that a two-to-one ratio is used for the warps threads regarding numbers. However, other ratios can also be used such as three-to-one or four-to-one. In that case then the sizes of threads are also in a like reverse ratio. For example, if there are three times the number of warp threads in the face band in comparison to the rear band then the size of the threads in the face band is one-third that in the rear band.

What is claimed is:

1. In a Venetian blind structure that comprises a Venetian blind tape that includes face and rear bands, each said tape constructed of a textile material woven from a loom, a plurality of evenly spaced rigid slats, a plurality of cross-band members that are inter-woven between said face and rear bands and that are spacedly disposed along said bands to form supports for respective ones of said evenly spaced blind slats, the improvement comprising, at least said face band having a discernable decorative pattern woven into it by means of a Jacquard weaving mechanism that is characterized by independent single thread control thereby, wherein the number of warp threads used for forming the face band is greater than the number of warp threads used for forming the rear band, and the size of the warp threads used for the face band is smaller than the size of the warp threads used for the rear band so as to provide the same respective densities for the face and rear bands to thus provide the proper face band and rear band fabric elongation characteristics for enabling proper blind closure.

2. The Venetian blind tape of claim 1 wherein the independent single thread control is of warp threads comprising at least part of the face band.

3. The Venetian blind tape of claim 2 wherein both the face and rear bands include weft threads.

4. The Venetian blind tape of claim 1 wherein the number of warp threads used for forming the face band is on the order of twice the number of warp threads used for forming the rear band.

5. The Venetian blind tape of claim 4 wherein the size of the warp threads used for the face band is on the order of one half the size of the warp threads used for the rear band.

6. The Venetian blind tape of claim 1 wherein the number of warp threads used for forming the face band is on the order of twice the number of warp threads used for forming the rear band and wherein the diameter of the warp threads used for the face band is on the order of one half the diameter of the warp threads used for the rear band.

7. The Venetian blind tape of claim 6 wherein the number of threads in the face band is on the order of 180 while the number of threads in the rear band is on the order of 90.

8. The Venetian blind tape of claim 7 wherein the threads in the face band are about 300 denier while the threads in the rear band are about 660 denier.

* * * * *